US007918966B2

(12) United States Patent
Trani et al.

(10) Patent No.: US 7,918,966 B2
(45) Date of Patent: Apr. 5, 2011

(54) METHOD FOR PRODUCING EXTENSIBLE PAPER, PLANT FOR IMPLEMENTING THE METHOD, PRODUCT OBTAINED BY THE METHOD, AND PAPER MATERIAL OBTAINED FROM THE PRODUCT

(75) Inventors: Giorgio Trani, Venice (IT); Marion Sterner, Venice (IT); Federico Cariolaro, Carmignano di Brenta (IT)

(73) Assignee: Cartiere Cariolaro S.p.A., Venizia (IT)

( * ) Notice: Subject to any disclaimer, the term of this patent is extended or adjusted under 35 U.S.C. 154(b) by 762 days.

(21) Appl. No.: 11/578,027

(22) PCT Filed: Apr. 13, 2005

(86) PCT No.: PCT/EP2005/003873

§ 371 (c)(1),
(2), (4) Date: Oct. 12, 2006

(87) PCT Pub. No.: WO2005/100686

PCT Pub. Date: Oct. 27, 2005

(65) Prior Publication Data

US 2007/0240841 A1 Oct. 18, 2007

(30) Foreign Application Priority Data

Apr. 14, 2004 (IT) ..... VE2004A0013

(51) Int. Cl.
*D21F 11/04* (2006.01)

(52) U.S. Cl. ..... 162/203; 162/135; 162/265

(58) Field of Classification Search ..... 162/203, 162/135, 265, 261, 365
See application file for complete search history.

(56) References Cited

U.S. PATENT DOCUMENTS

| | | | |
|---|---|---|---|
| 3,290,209 | A | 12/1966 | Ihrman |
| 6,024,832 | A | 2/2000 | Trani et al. |

FOREIGN PATENT DOCUMENTS

| | | |
|---|---|---|
| EP | 1 466 952 | 10/2004 |
| WO | WO 97/27364 A | 7/1997 |
| WO | WO 2004/029361 | 4/2004 |

OTHER PUBLICATIONS

WO 2004/029361, Date: Aug. 2004, translated copy.*

* cited by examiner

*Primary Examiner* — Mark Halpern
(74) *Attorney, Agent, or Firm* — Welsh Flaxman & Gitler LLC

(57) ABSTRACT

The paper web is passed on the production line between at least one pair of rollers, of which one is of soft material driven at greater speed, the hard material roller presenting a base roughness RA of less than 5 and along its entire lateral surface having incisions that are precisely spaced.

5 Claims, 2 Drawing Sheets

METHOD FOR PRODUCING EXTENSIBLE PAPER, PLANT FOR IMPLEMENTING THE METHOD, PRODUCT OBTAINED BY THE METHOD, AND PAPER MATERIAL OBTAINED FROM THE PRODUCT

This application is a 371 of PCT/EP05/03873 filed 13 Apr. 2005

BACKGROUND OF THE INVENTION

The present invention relates to a method for producing extensible paper, a plant for implementing the method, a product obtained by the method, and a paper material obtained from the product.

Extensible paper is a known paper which, because of special treatment during its production, presents considerable extensibility both in the longitudinal direction (i.e. in the direction of its advancement along the production line) and in the transverse direction (i.e. in the direction perpendicular to the preceding). This treatment consists essentially of passing the paper web, not yet formed and presenting a moisture content of about 35%/45%, between two rollers rotating at different speeds. One of these rollers, generally the lower roller, is made of rubber and is rotated at lower speed, while the upper roller is made of steel and comprises in its cylindrical surface a continuous spiral-shaped groove. The different material nature and the different speed of the two rollers results in a sort of longitudinal accumulation of the paper forming material and prepares it for longitudinal extensibility, by an amount which can reach 15-20%. At the same time, the spiral groove performs a double function: on the one hand it causes a sort of transverse accumulation of the material forming the paper, to prepare it for transverse extensibility, by an amount which can reach 10-15%. On the other hand the spiral groove contributes to maintaining longitudinal advancement of the processed paper web along the machine.

The longitudinal and transverse paper accumulation as a result of its passage between the two rollers, and the particular method by which this is achieved, results in the formation, in the paper web leaving the machine, of a series of folds, compactions or heaps which extend for various lengths with a pattern reflecting the surface of the steel roller, and cover the entire surface of the web. In their turn, these folds define in the paper a sort of accentuated macroscopic roughness, giving rise to serious problems which substantially limit its use.

One of these problems, related to the widespread use of this type of paper in the packaging field, in which it has to be coupled to plastic film or other impermeabilizing layers, is that the accentuated roughness makes it more difficult for the impermeabilizing layer to correctly and uniformly adhere to the extensible paper web, resulting in possible detachment between the two when the combination is subjected to deformation to produce three-dimensional packs.

Another problem is that because of the particular undulated geometry of the product web, the accentuated roughness results in a substantial decrease in rigidity, i.e. in bending resistance, which is very important for packaging materials.

Another problem is that although the accentuated roughness is far removed from the crinkling used in the past to produce extensible paper, it still forms an obstacle to the deposition of ink, and essentially an obstacle to correct printing, which on the contrary would require the smoothest possible surface.

The invention proposes to eliminate these problems, i.e. to provide a paper which simultaneously presents considerable extensibility characteristics while being substantially free of surface roughness, measurable in terms of order of magnitude on the Bendsen scale, consequently making it uniformly rigid, easily coupled to impermeabilizing layers, and printable without particular problems and with satisfactory results on traditional printing machines.

SUMMARY OF THE INVENTION

This and further objects which will be apparent from the ensuing description are attained by a method for producing substantially smooth extensible paper.

The paper web is passed on the production line between at least one pair of rollers, of which one is of soft material driven at greater speed, the hard material roller presenting a base roughness RA of less than 5 and along its entire lateral surface having incisions that are precisely spaced.

BRIEF DESCRIPTION OF THE DRAWINGS

A preferred embodiment of the present invention is described in detail hereinafter with reference to the accompanying drawings, in which.

DETAILED DESCRIPTION OF THE INVENTION

Figure 1:
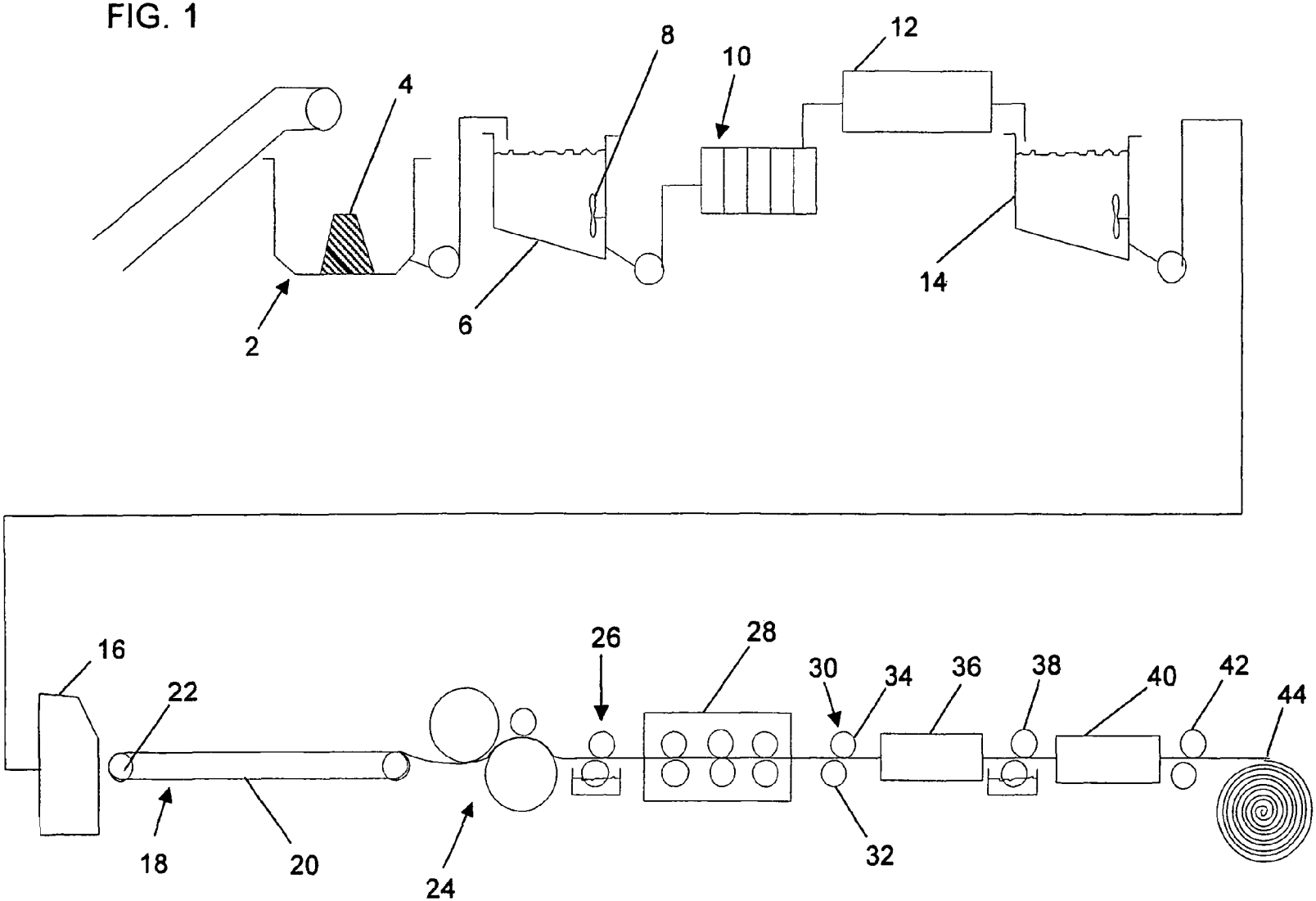
FIG. 1 is a schematic view of a plant for implementing the process of the invention.
Figure 2:
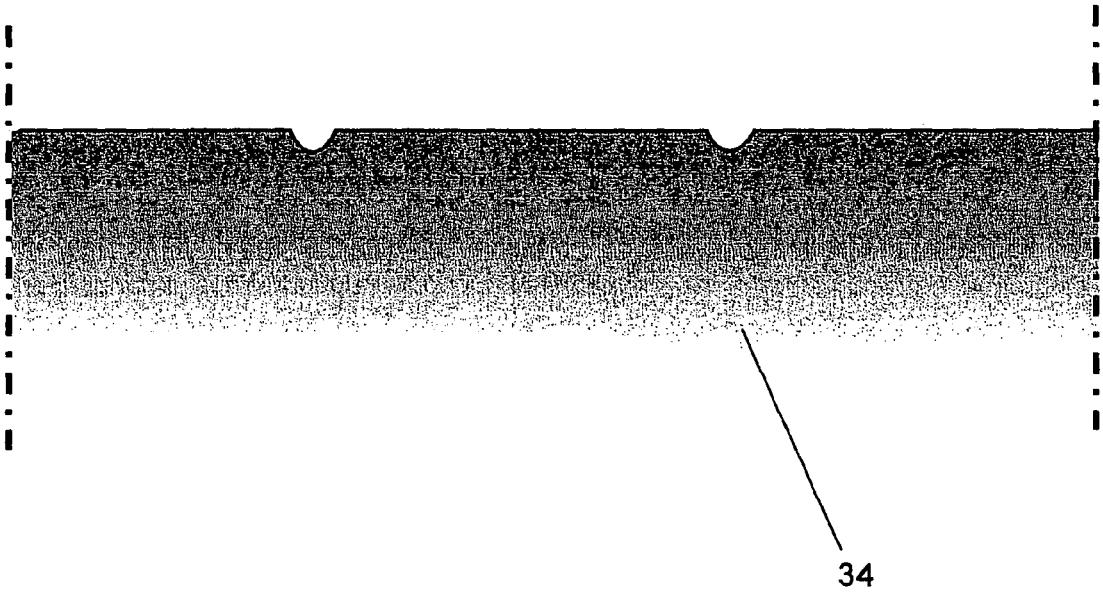
FIG. 2 is an enlarged longitudinal section through a roller for implementing the compaction stage.

As can be seen from the figures, the extensible paper production plant comprises essentially a high density kneader 2 consisting substantially of a cylindrical tank with an inverted frusto-conical base and housing internally a conical impeller 4 having a helical projection on its surface.

The kneader is connected to a storage vat 6 provided with a stirrer and connected to a refining station 10 formed from refining units alternating with storage vats. The exit from the last refining unit is connected to another refining unit 12 of the perforated ring type, connected to a storage vat 14 which communicates with a flow chest 16 feeding a paper web forming station. This station 18 comprises a cloth 20 extending between two return rollers 22 and able to support the mix of water and fibrous raw materials, with progressive water extraction by vacuum.

The downstream end of the paper web forming station is connected to a pressing station 24, downstream of which a first impregnation station 26 is provided.

Downstream of the impregnation station there is a hot roller drying station 28 ensuring a constant paper web water content of between 15% and 65%, preferably 40%, followed by a compacting station 30 comprising pairs of rotating rollers 32, 34. The lower roller 32 is made of rubber and is rotated at a certain speed, while the upper roller 34 which rotates at higher speed is of steel, it presents a base roughness less than 1 and comprises a plurality of incisions extending in a circumferential direction. The following table shows the incision values in mm, with the range limits and optimum values being shown.

| mm | RANGE LIMITS | OPTIMUM RANGE |
|---|---|---|
| Distance A between incisions | 0.10-40 | 0.8-2.5 |
| Incision width B | 0.02-2 | 0.05-4 |
| Incision depth C | <0.1 | ≅0.05 |

-continued

| mm | RANGE LIMITS | OPTIMUM RANGE |
|---|---|---|
| Ratio A/B distance/width | 0.12-800 | 2.2-20 |
| Ratio B/C width/depth | 0.5-20 | 1-8 |

The exit of the compaction station 30 is connected to a second drying station 36 which is connected to an impregnation or coating station 38, followed by a third drying station 40. At the exit from the drying station a glazing station 42 is provided, followed by a paper winding station 44.

The drying stations ensure a paper web moisture content between 4% and 15%, preferably 10%.

The plant of the invention also comprises a series of automatic controls ensuring correct implementation of the operative cycle and which will be described as they appear in the course of the following description of operation.

The operation of the plant of the invention will now be described with reference to the passages of the forming paper web through the successive stations.

Bales of fibrous raw material are fed to the kneader 2 at high density, together with the predetermined quantity of water, for their mixing. Herein the mix is kneaded, mixed with water and particular additives the purpose of which is to increase the ultimate tensile stress of the fibres, to homogenize the water/fibre mix and to give the obtained paper special characteristics.

The fibrous raw material consists of vegetable fibres which can be long cellulose fibres, short cellulose fibres or other fibres obtained from vegetation other than wood (cotton linters, hemp, flax, esparto, kenaf) or synthetic fibres (polypropylene, polyester, polyethylene, Lycra®).

By rotating the impeller 4 the fibrous raw material is progressively kneaded, the fibres maintaining their original length, and is intimately mixed with water and with the additives fed into the kneader. The additives can include starch, which is able to bind the fibres together and increase their ultimate tensile stress, or carboxymethylcellulose (CMC), which is able to disperse the fibres and hence prevent their coagulation, or synthetic resins and/or latex, which bind the fibres of the mix together by forming a type of elastic bond.

A mix of fibre, water and additives with a dry content of about 15% leaves the kneader 2, this mix then being diluted and fed into the subsequent refining station 10, to be subjected to the action of a refining unit preferably comprising lava discs, which work the fibres substantially without cutting them, but hydrate them to give the mix particular characteristics. By this treatment the fibres are modified such as to facilitate their damming, with formation of a homogeneous continuous structure, essential for the characteristics which the finial product must present.

The degree of mix refining can be determined on the basis of objective parameters measured in ° SR (Shopper Reagler); according to the present invention the mix leaving the refining treatment must present from 30° SR to 60° SR depending on the paper density to be obtained.

The different raw materials can be refined either along the same line or, preferably, along different lines.

On leaving the last refining station the mix, which as stated presents from 30° SR to 60° SR, is fed into the perforated ring refining unit operating at a density of 20%, the function of which is to hydrate the fibres, swell them and curl them. The mix is then fed into the storage vat 14 and from there into the flow chest 16, from which, with a dry content of about 0.5-1%, it is poured onto the underlying cloth of the paper web forming station 18.

Along the initial portion of this cloth the mix tends to progressively eliminate water firstly by gravity and then by suction, until it presents a dry content of about 18% at the cloth exit end.

The paper web leaving this station is passed into the station 24 for pressing between pressing rollers and felts, to lose water and attain a dry content of about 45%.

The paper web then passes to the first impregnation station 26, where it is treated with a solution of various additives the function of which is to improve the paper extensibility characteristics and/or to improve the production technology. This impregnation is preferably achieved with a spray device, but can also be achieved with other systems, for example by passing the forming paper web through tanks containing the impregnating solution. In any event the quantity of impregnant is controllable, with considerable advantages both in terms of cost of the substance used and in terms of exact determination of this substance.

The paper web impregnated in this manner is dried in the first drying station 28 to a dry content of about 50-70% by passage between two hot rollers or through a hot air tunnel, before being subjected to compaction treatment.

In passing from the pressing station 24 to the compacting station 30 the roller speed is adjusted such that the paper is subjected to a tension which provides a maximum longitudinal stretch compatible with its breakage resistance, in order to obtain a transverse contraction of the paper, providing a reserve for transverse extensibility.

The compaction, which takes place both in the longitudinal and transverse directions, is effected by passing the paper web between the pair of rollers 32, 34. In this manner the braking effect on the forming paper web during its passage between the two rollers, combined with the pressure between the two rollers and the material, determines a shortening as a result of the compaction and an increase in the density of the paper web, together with a series of compactions in the longitudinal direction, which extend transversely with various lengths and with a pattern related to the pattern of the incisions in the steel upper roller. The function of these incisions is to regularize and unify the length of the incisions and hence obtain at the roller exit a web which is more regular over the whole of its height, in the sense of presenting a uniform compaction distribution both in the longitudinal and in the transverse direction.

Although a roller is used having a very smooth surface (necessary to achieve better glazing) which could result in a loss of transverse extensibility, the incisions determine an accumulation of material in the transverse direction in correspondence with the incisions, to hence regain transverse extensibility.

It should be noted that in the known art, if the roughness of the steel roller is lessened, after a short time it tends to actually become smooth, resulting in a strong reduction in transverse extensibility and a product, the final characteristics of which are not constant.

In contrast the presence of the incisions, given their permanence even if the roller is worn, produces transverse extensibility which is constant with time.

On termination of the compaction stage, the paper is subjected to further drying in the station 30 to achieve a dry content of about 85% to 98%, preferably 95% which is necessary for the coating stage.

should be noted that from the compacting station 30 to the exit of the drying station 36 the roller speed is maintained substantially constant in order not to induce any traction stress which would result in the compacted paper losing part of its longitudinal extensibility.

On its exit from the drying station 36 the paper is subjected to coating in the corresponding station, followed by drying, glazing, calendering and winding on the final roll 44.

The paper web obtained in this manner presents, in particular because of the refining, impregnation and compacting treatment, a high degree of mechanical strength, a longitudinal extensibility of at least 12% and a transverse extensibility of at least 9%.

From the aforegoing it is apparent that the method of the invention enables a paper to be obtained having greater rigidity, comparable to that of normal paper, and at the same time a degree of smoothness of less than 3000 on the traditional Bendsen scale. This degree of smoothness results in better printability, better adhesion for producing combinations, and more uniform thickness. Its degree of smoothness and rigidity also enable the paper to be subjected to surface treatment, for example coating and/or other surface treatments.

Such a degree of smoothness also enables subsequent glazing to be done at higher pressures, so optimizing printing and rigidity.

The glazed paper obtained in this manner can be associated with an impermeabilizing agent or with a sheet of impermeable material to obtain a combination paper.

What is claimed is:

1. A method for producing smooth extensible paper, comprising passing the paper web on the production line between at least one pair of rollers, of which one is of a soft material driven at lesser speed and one is of hard material driven at greater speed, the hard material roller comprising a base lateral surface with an average roughness Ra of less than 5 μm and further comprising, on an entire lateral surface, incisions having the following parameters:

| | |
|---|---|
| distance A between adjacent incisions | 0.10-0.40 mm |
| width B of each incision | 0.02-0.2 mm |
| depth C of each incision | 0.02-0.1 mm. |

2. The method as claimed in claim 1 wherein the incisions extend in the circumferential direction.

3. The method as claimed in claim 1, wherein the distance between adjacent incisions is about 0.24 mm.

4. The method as claimed in claim 1, wherein the width of each incision is about 0.06 mm.

5. The method as claimed in claim 1, wherein the depth of each incision is about 0.05 mm.

* * * * *